US010681951B2

(12) United States Patent
Bar-Cohen et al.

(10) Patent No.: US 10,681,951 B2
(45) Date of Patent: Jun. 16, 2020

(54) HELMET IMPACT SELF-CONTROLLED RESTRAINER (HISCOR) FOR PROTECTING FOOTBALL PLAYERS HEAD FROM TRAUMA AND CONCUSSION INJURY

(71) Applicants: Yoseph Bar-Cohen, Pasadena, CA (US); Mircea Badescu, La Canada Flintridge, CA (US); John Rodney Wright, Jr., Seal Beach, CA (US)

(72) Inventors: Yoseph Bar-Cohen, Pasadena, CA (US); Mircea Badescu, La Canada Flintridge, CA (US); John Rodney Wright, Jr., Seal Beach, CA (US)

( * ) Notice: Subject to any disclaimer, the term of this patent is extended or adjusted under 35 U.S.C. 154(b) by 0 days.

(21) Appl. No.: 16/129,482

(22) Filed: Sep. 12, 2018

(65) Prior Publication Data

US 2020/0015538 A1 Jan. 16, 2020

Related U.S. Application Data

(60) Provisional application No. 62/563,567, filed on Sep. 26, 2017.

(51) Int. Cl.

| | |
|---|---|
| ***A42B 7/00*** | (2006.01) |
| ***A42B 3/04*** | (2006.01) |
| ***A42B 3/08*** | (2006.01) |
| ***A42B 3/06*** | (2006.01) |
| *A41D 13/05* | (2006.01) |
| *A42B 3/14* | (2006.01) |

(52) U.S. Cl.

CPC ..... *A42B 3/0473* (2013.01); *A42B 3/06* (2013.01); *A42B 3/08* (2013.01); *A41D 13/0512* (2013.01); *A42B 3/142* (2013.01)

(58) Field of Classification Search

CPC ..... A42B 3/0473; A42B 3/06; A42B 3/048; A42B 3/08; A41D 13/0512

USPC ..... 2/421, 461, 459, 413; 267/64.13

See application file for complete search history.

(56) References Cited

U.S. PATENT DOCUMENTS

| | | | | |
|---|---|---|---|---|
| 2004/0194194 | A1* | 10/2004 | McNeil | A42B 3/0473 2/421 |
| 2008/0209617 | A1* | 9/2008 | Castillo | A41D 13/0512 2/461 |
| 2012/0305350 | A1* | 12/2012 | Ericksen | F16F 9/486 188/269 |
| 2013/0205480 | A1* | 8/2013 | Nagely | A63B 71/1291 2/425 |
| 2016/0157543 | A1* | 6/2016 | Huang | A42B 3/0473 2/411 |

* cited by examiner

*Primary Examiner* — Timothy K Trieu

(57) ABSTRACT

The invention is intended to protect football players, race car drivers and others. An apparatus that dampens impacts and prevents rapid movement of user's head protected by helmets. Two embodiments are disclosed using piston configuration. In one embodiment, the piston is moving inside a housing filled with a viscoelastic fluid and the other is a locking piston dampener mechanism.

12 Claims, 10 Drawing Sheets

HELMET IMPACT SELF-CONTROLLED RESTRAINER (HISCOR) FOR PROTECTING FOOTBALL PLAYERS HEAD FROM TRAUMA AND CONCUSSION INJURY

CROSS-REFERENCE TO RELATED APPLICATIONS

This application claims priority to and the benefit of U.S. provisional patent application Ser. No. 62/563,567, filed Sep. 26, 2017, which application is incorporated herein by reference in its entirety.

STATEMENT REGARDING FEDERALLY FUNDED RESEARCH OR DEVELOPMENT

The invention described herein was made in the performance of work under a NASA contract, and is subject to the provisions of Public Law 96-517 (35 USC 202) in which the Contractor has elected to retain title.

FIELD OF THE INVENTION

The invention relates to mechanical structures in general and particularly to apparatus and methods of preventing rapid movement of the human head relative to the body.

BACKGROUND OF THE INVENTION

Various sports are involved with potential rapid movement of the player's head and it is one of the most common causes of injury resulting from impact force that leads to concussion and other traumas. Football is one of the most popular sports among youth. However, according to the American Orthopedic Society for Sports Medicine website, it is leading in the number of injuries that are sustained by the players. Besides injuries and long term damage, it also causes death to players. According to the U.S. Product Safety Commission, in 2007 close to one million football-related injuries of athletes under the age of 18 were treated in emergency rooms, doctor's offices, and clinics. Regardless of the protective equipment that is currently used, the force that brings the players down to the ground leads to bodily injury and the highest concern is that of damage to the players' head and neck.

There is a need to protect the head of players and their susceptibility to concussion, which is a change in the mental state due to a traumatic impact. The helmets that are currently in use are unable to prevent the high speed forceful movement of the head that results from impact during games.

There is a need for protecting the head of users of plurality of games, particularly in football and car racing.

There are previous solutions for protecting the player's from impacts during the games and we will cite some of them here.

U.S. Pat. No. 1,944,194 issued to McNeil et. al. on Mar. 15, 2004, discloses a sport equipment for protecting the cervical spine where a pair of cylinders connect the helmet to the shoulders or a vest on the players and are interconnected and controlled by an outside pilot-operated valve. The cylinders are rigidized when an impact creates a higher pressure inside the cylinders but this equipment only prevents the cervical spine from being compressed in the axial direction.

U.S. Pat. No. 209,617 issued to Castillo on Feb. 28, 2008, discloses a system for protecting the head by connecting a helmet to the shoulder cuff using a plurality of pistons interconnected with tubes to a central reservoir.

U.S. Pat. No. 305,350 issued to Ericksen et. al. on May 31, 2012, discloses a position sensitive and position activated apparatus for dampening the motion of a piston inside a cylinder that may not be activated in the fully extended configuration of the apparatus.

U.S. Pat. No. 157,543 issued to Huang et. al. on Dec. 4, 2015, discloses a device to reduce traumatic brain injury that includes a sensor, a linkage, and a processing element. The motion restriction of the linkage element is controlled electrically (sensor and processing unit) and a fluid moves thru a side path.

Although the devices and methods present in the prior art deserve undeniable merits it is believed that the method and apparatus presented in the current solution are different from prior art, present a simpler solution and a higher level of protecting the players from impacts or higher accelerations/decelerations.

SUMMARY OF THE INVENTION

According to one aspect, the invention features an apparatus, comprising a mechanical structure having a plurality of dampeners attached to a base structure and a top structure that are connecting the helmet to the shoulder and chest of the user. The dampener is a self-controlled device that becomes rigid upon being subjected to high velocity movement that takes place when the helmet is impacted.

In one embodiment, the apparatus that consists of a plurality of dampeners controls the same number of Degrees of Freedom (DoF). This apparatus dampens independent movement of the head relative to the torso. The dampeners are configured to allow length adjustment to match the dimensions of different players. Rigidizing the dampeners locks the helmet position relative to the torso and distributes the impact force to the player's body. Thus, the acceleration and speed of the head are dampened.

In another embodiment, the dampeners are designed in a piston configuration where the large area of the piston pushes on a viscoelastic paste (such as "silly-putty"). The paste behaves as viscous fluid when subjected to slow motion but becomes rigid material when subjected to high speed movement.

In another embodiment, the dampener contains a fluid as a dampening filler to reduce the acceleration of the players head when it is subject to impact.

In yet another embodiment, the dampener contains actively controlled viscosity fluid that dampens rapid movement by using control electronics. Such fluids include Electro Rheological Fluids (ERF) that in milliseconds become increasingly viscous with the increase in the electric field to which they are subjected. In addition, Magneto Rheological Fluids (MRF) respond in milliseconds with increasing viscosity as a function of the increase in the magnetic field. ERF and MRF require a sensor, such as an accelerometer or impact sensor, to indicate to the apparatus that activation is needed and at what level.

In yet another embodiment, pistons are used with an integrated locking mechanism immersed in a fluid inside a housing. The piston includes a free floating perforated element that is constrained by a set of springs. Motion of the piston with an up to a predefined speed level allows the piston to move freely inside the housing. If the predefined speed is exceeded the fluid flows through the floating element overcomes the spring force and moves the floating element to block the fluid flow through the piston and locks the piston. Locking the piston locks the dampener and prevents the relative motion of its extremities.

In yet a further embodiment, it is designed to prevent rapid rotation and displacement of the helmet along the various potential axes onto which the head may be caused to rapidly move.

In still a further embodiment, the apparatus dampeners are covered with a shroud to protect the user from having other players grab the dampeners and use them as a handle.

In another embodiment, the shroud cover has printed graphics such as advertisement.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

DETAILED DESCRIPTION

Figure 1:
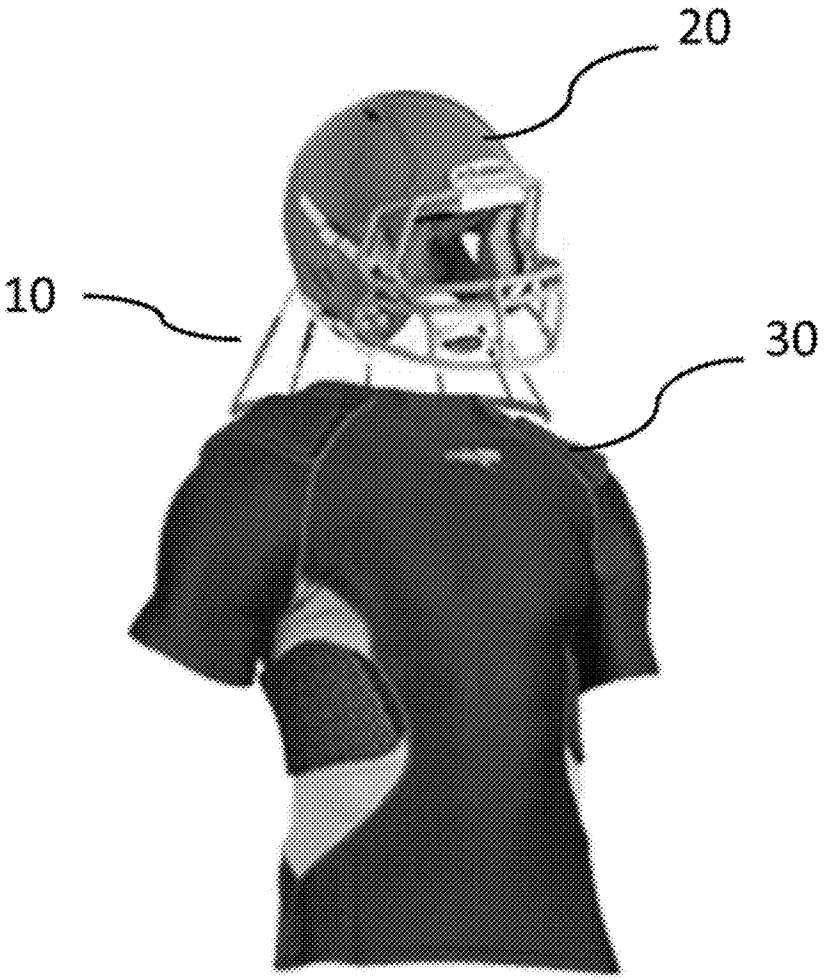
FIG. 1 is a perspective view of the Helmet Impact Self-Controlled Restrainer (HISCoR) apparatus with 6 self-controlled dampeners mounted on a user' body.

We describe a novel design of a Helmet Impact Self-Controlled Restrainer (HISCoR) designed to prevent rapid rotation and displacement along the various potential axes onto which the head may be caused to move rapidly. The restrainer, 10, shown in FIG. 1 is attached to the player's helmet, 20, and upper body, 30.

To prevent the possibility of another player grabbing the individual dampeners of the HISCoR apparatus and use it as a handle, a shroud covers the restrainer, 10. To make the shroud visually pleasing it is produced in colors with printed graphics.

Figure 2:
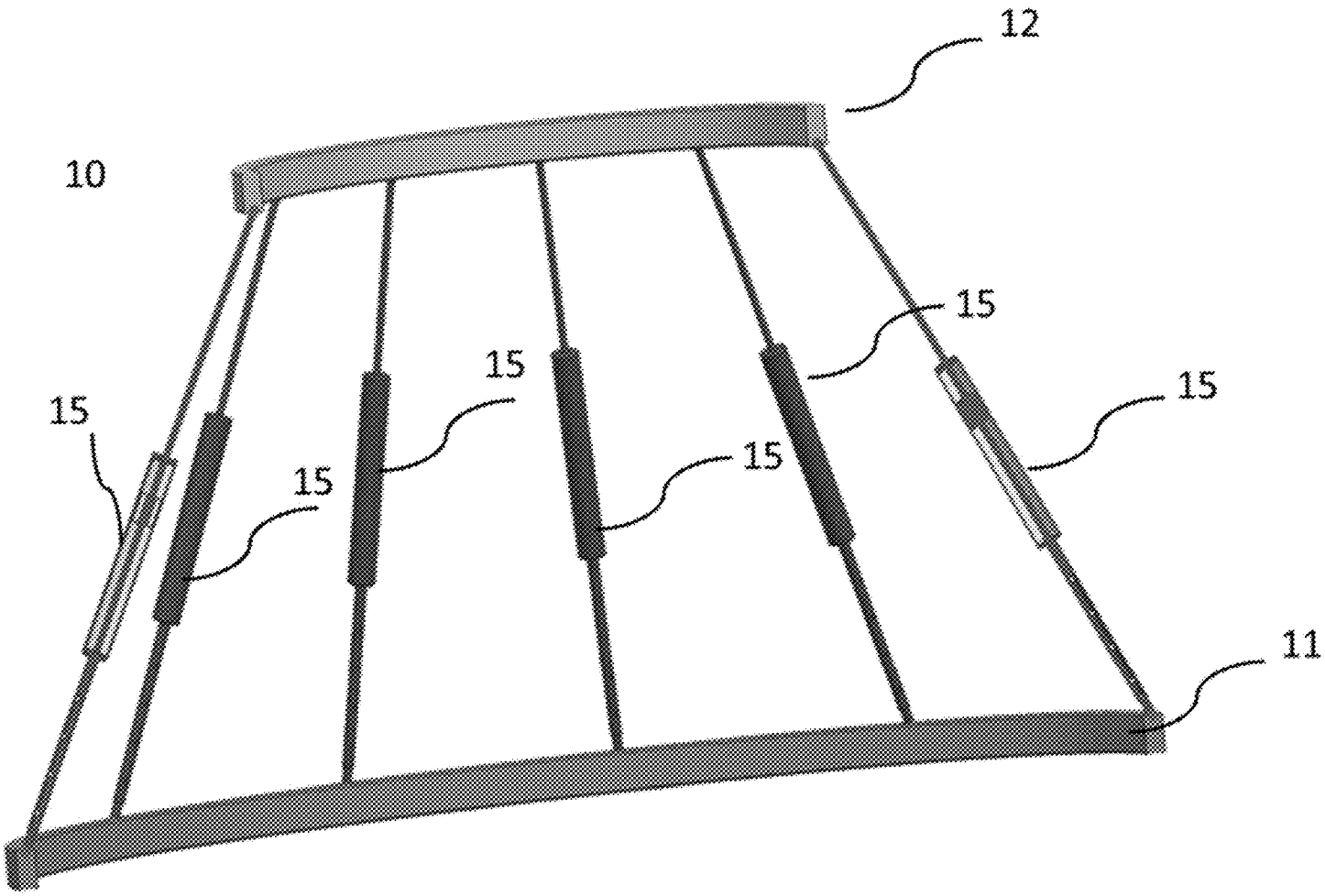
FIG. 2 is a perspective view of the Helmet Impact Self-Controlled Restrainer (HISCoR) fixture with 6 self-controlled dampeners.
Figure 3:
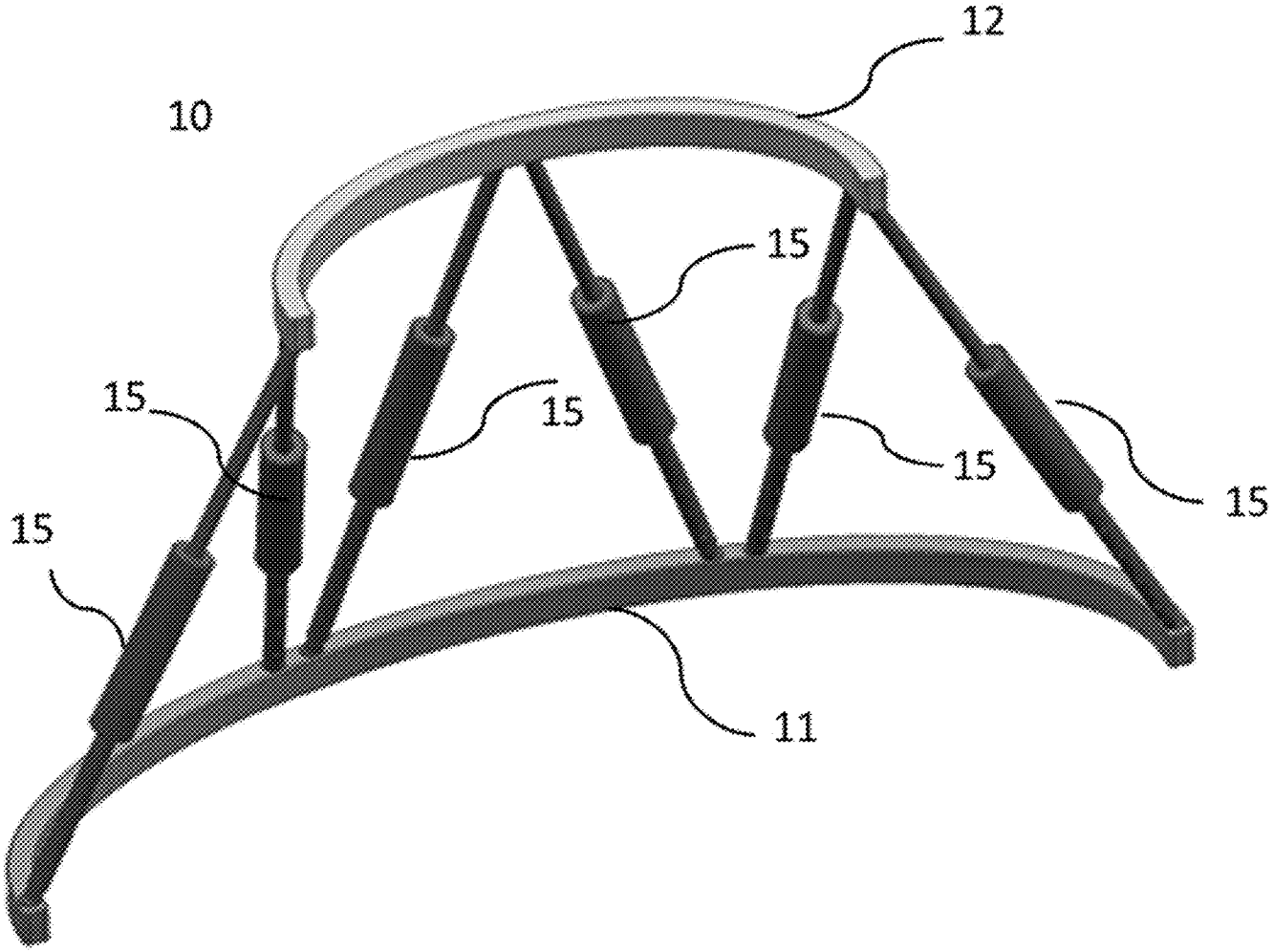
FIG. 3 is an isometric view of the Helmet Impact Self-Controlled Restrainer (HISCoR) apparatus where the 6 self-controlled dampeners are positioned in a different configuration than the dampeners in FIG. 2.

The restrainer includes a base structure, 11, a top structure, 12, and a plurality of connecting elements, 15, as shown in FIG. 2 and FIG. 3. The connecting elements, 15, allow axial motion and can be locked to restrain the relative motion of the top structure, 12, with respect to the base structure, 11, and, consequently, of the helmet 20 with respect to the upper body 30 or can be used as dampening elements. The number and location of the connecting elements, 15, is determined by the number of the degrees of freedom of movement of the helmet 20 with respect to the body 30 that need to be restrained and the range of motion the helmet is allowed. FIGS. 2 and 3 show two such possible configurations.

Figure 4:
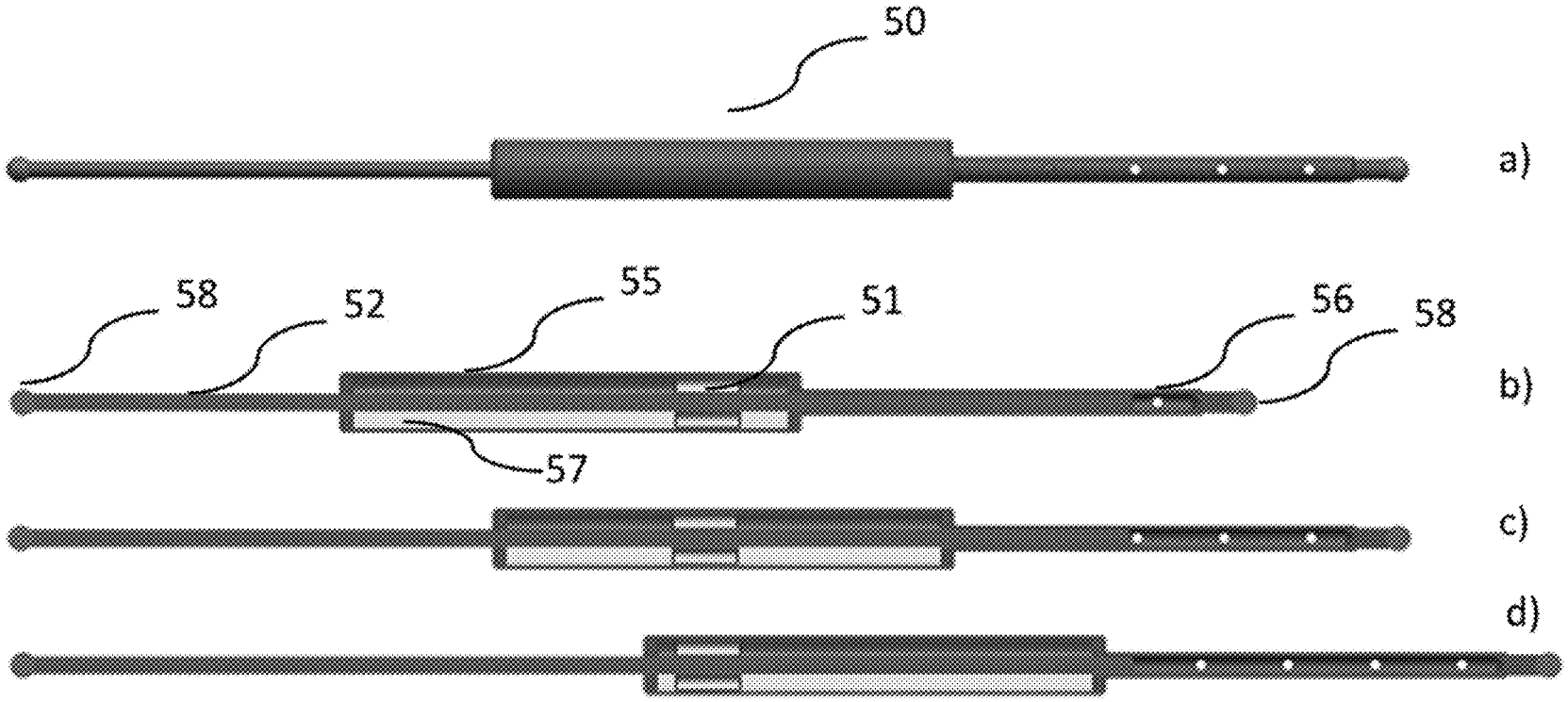
FIG. 4 is a side view of a dampener (FIG. 4, a)) and cross-section at three extension positions when being moved slowly (FIG. 4 b), c) and d)). Ball joints on the two ends are used to provide flexible rotation of the dampener on the mounting platform. The ball joints at the two ends can be replaced by universal joints (2 DoF) with the addition of allowing the piston inside the cylinder to rotate freely around the central axis. Holes on the back shaft allow free movement of the support rod when moved slowly preventing the buildup of air pressure to restore the assembled piston position.

In one embodiment, as shown in FIG. 4, a dampener element, 50, consists of a piston, 51, with axial through holes and a shaft, 52, extending on both ends of the piston. The piston is enclosed in a cylinder, 55, that extends with a hollow shaft, 56. The free end of the piston shaft connects to one base or top structure and the end of the cylinder shaft connects to the other using ball joints, 58. The cylinder-piston shaft interfaces are sealed creating a cavity that is filled with a fluid. The fluid inside the cylinder flows along the axial holes in the piston and moves back or forth depending on the direction of the piston movement. When slowly pushed back or forth, the piston moves freely inside the cylinder. At higher velocity, the movement of the piston creates a larger resistance force resulting in constraining its motion along the central axis and so restraining the motion of the helmet.

The fluid inside the dampener element consists of a viscoelastic fluid, such as a "silly-putty" paste, inside the cylinder, which is self-activated, taking advantage of these fluids' property of being viscous liquid at low movement speeds but becoming rigid at high movement speeds. An illustration of a viscoelastic filled dampener and cross-section at three extension positions when being moved slowly are shown in (FIG. 4).

The ball joints, 58, on the two ends of the dampening element are used to provide flexible rotation of the dampener on the mounting structure. The ball joints at the two ends can be replaced by universal joints (2 DoF) when the piston inside the cylinder is allowed free rotation about the central axis. Holes on the cylinder hollow shaft allow free movement of the piston shaft when moved slowly, preventing the buildup of air pressure to restore the assembled piston position.

Any fluid (including water) is suitable as a dampening material for the floating element piston configuration.

Active fluid can provide controlled dampening. It uses control electrics and it is electrically powered and equipped with impact sensor to indicate the need to activate the dampener and the required level.

Electro Rheological Fluids (ERF) provides active fluid material. These fluids respond in milliseconds to become viscous at levels that are relative to the electric field to which they are subjected.

Magneto Rheological Fluids (MRF) also provides active fluid material. These fluids respond in milliseconds can become viscous relative to the magnetic field to which the fluids are subjected. MRF are used in most of the high end cars today, the shock absorbers are equipped with MRF.

Figure 5:
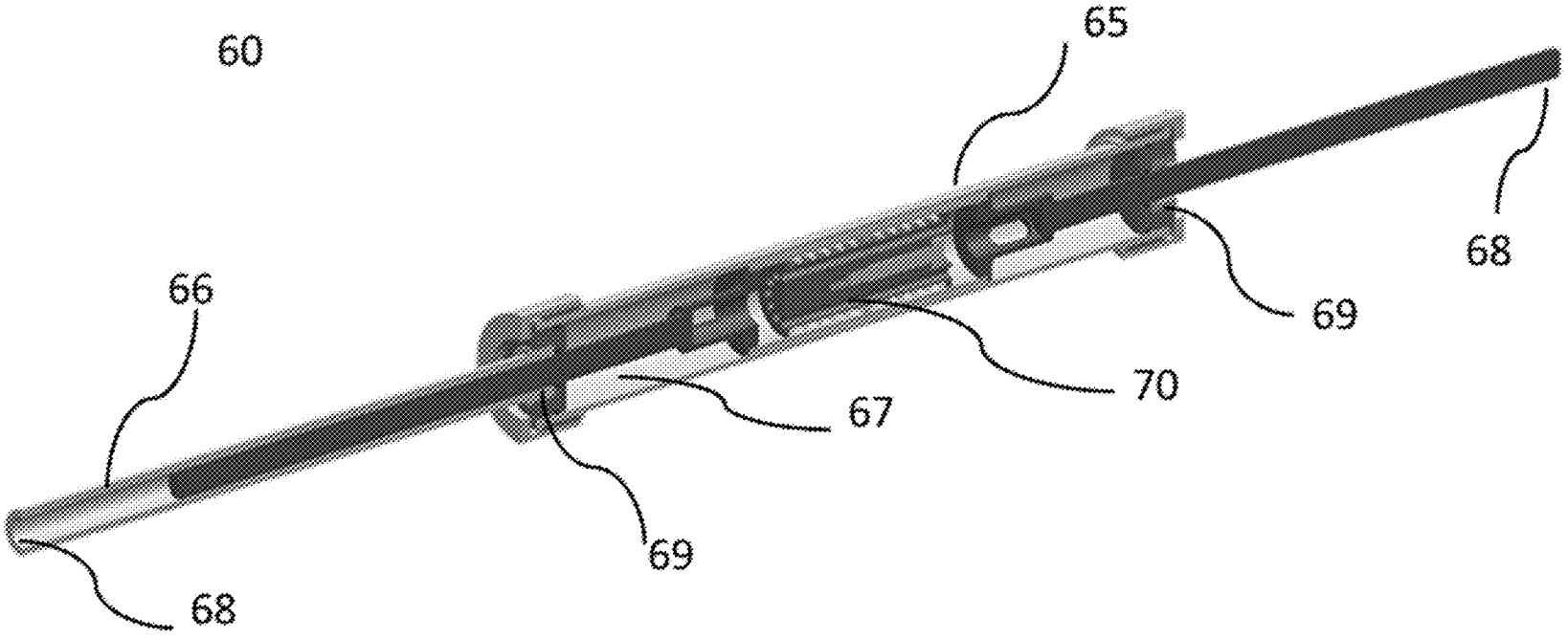
FIG. 5 is cross-section side view of the locking piston dampener with free floating piston.
Figure 6:
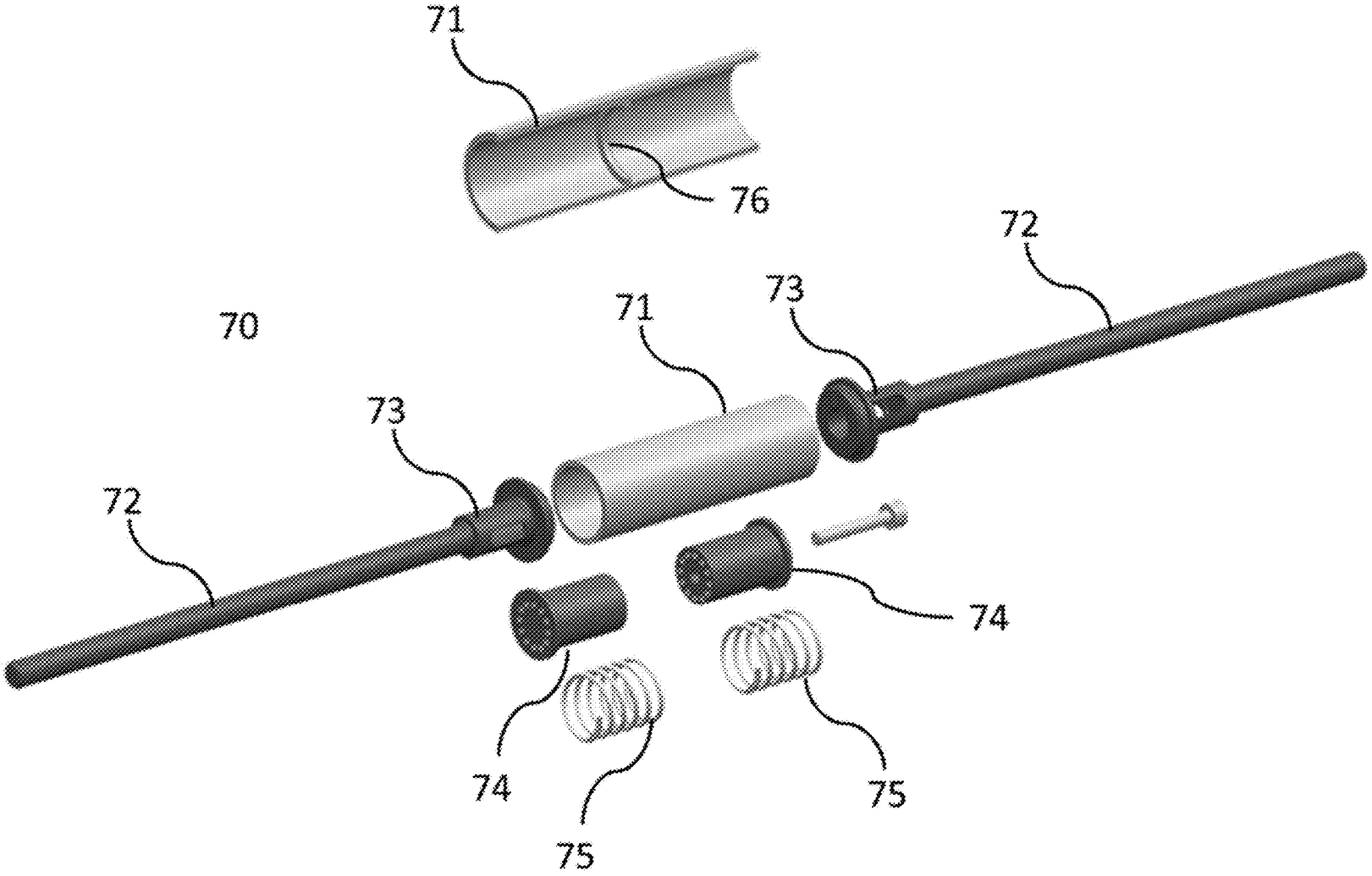
FIG. 6 is view of a piston with locking mechanism components.

In yet another embodiment, a locking piston dampener is shown in FIG. 5 where the element includes a piston, 70, enclosed in a cylindrical housing, 65, having a hollow shaft, 66. The piston 70 (FIG. 6) includes a through shaft, 72, a floating element 74, with through axial holes, floating inside a piston body, 71. The piston body, 71, includes a stop feature, 76. The position of the free floating element, 74, is controlled by two springs, 75. In FIG. 6, for case of fabrication, the piston through shaft is shown as two components, 72, that will be attached to the piston body, 71. In addition, the through shaft includes holes that allow the fluid on one side of the piston to pass through the piston body to the other side.

One end of the hollow shaft, 66, and the one end of the through piston shaft, 72, represent the two ends, 68, of the dampening element, 60. One end will connect to one of the base or top structure and the other end will connect to the other. The housing, 65, presents two seals, 69, for the piston shafts creating a sealed cavity, 67, filled with a fluid. The piston body, 71, is enclosed in this fluid filled cavity and the through shaft extends through both ends of the cavity. Having the piston shaft extend through both ends of the cavity maintains constant volume of the parts inside the fluid filled cavity, 67, regardless of the position of the piston in this cavity.

Figure 7:
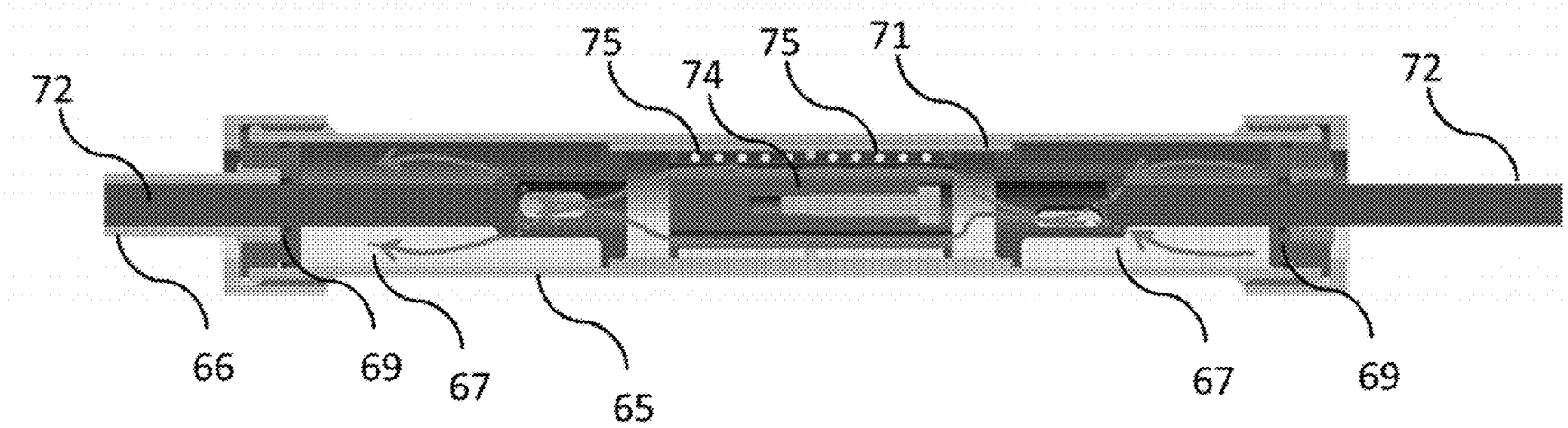
FIG. 7 is a view of the fluid flow inside the dampener housing when the piston moves to the right at low speed relative to the housing.

When the piston moves slowly from one side to the other, the fluid accommodates this movement by flowing inside the housing through the piston. FIG. 7 shows the fluid flow inside the dampener element when the piston, 70, moves to the right relative to the housing, 65, at low speed. Inside the piston, there is a free floating element, 74, constrained by the two springs, 75, which allows the fluid to move from one side of the piston body to the other. When the piston moves with a speed higher than a predefined value, the drag on the free floating element overcomes the forces in the springs and moves the free floating element against one side of the piston blocking the flow through the axial orifices and thus preventing the fluid flow. The fluid flow prevention locks the piston in place. Locking the pistons of the dampener elements restrains the motion of the helmet relative to the body. Releasing the acting force on the piston shaft attachment or changing the motion direction unlocks the piston.

Figure 8:
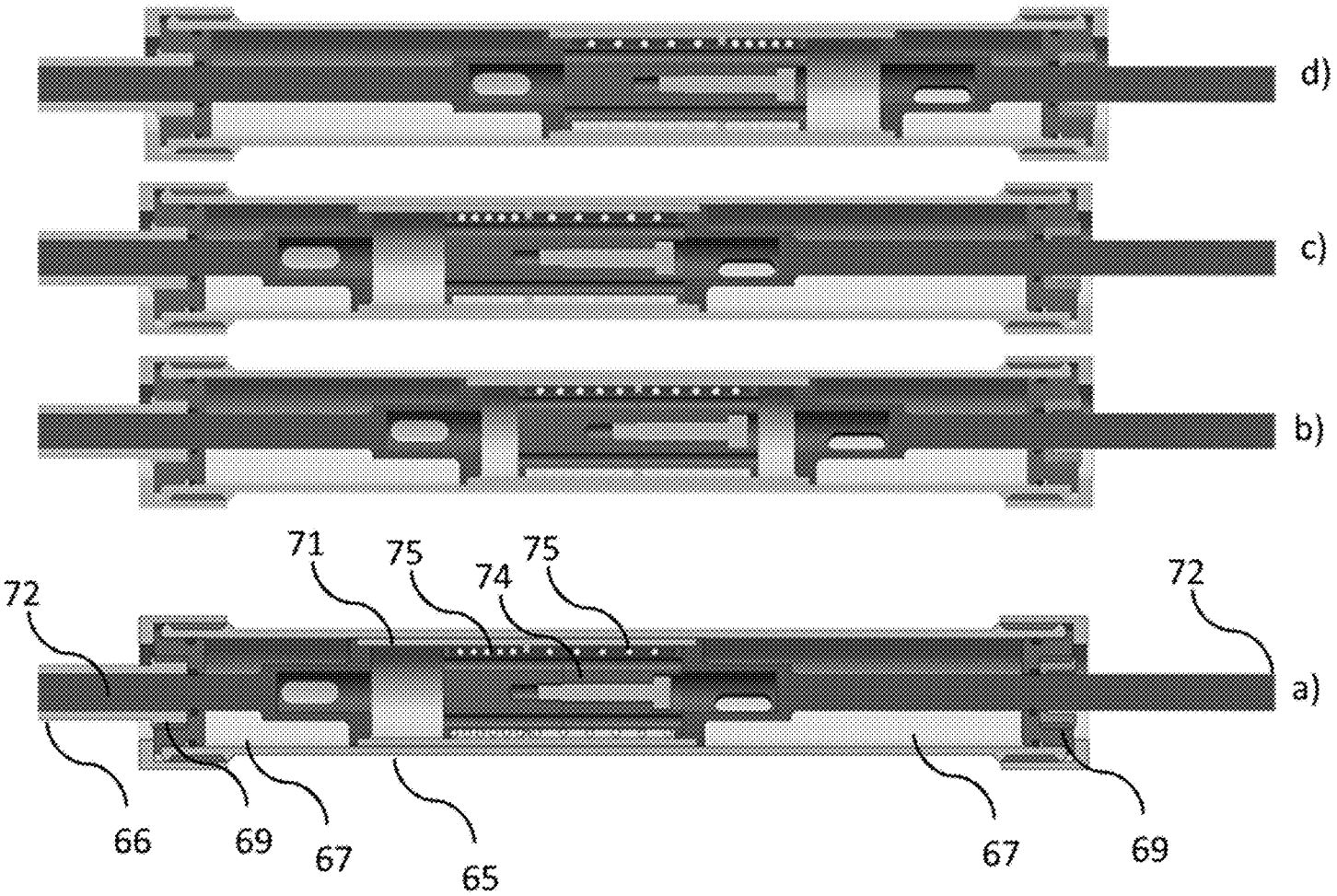
FIG. 8 is a schematic diagram of the piston and locking mechanism location when the piston is in static position (FIG. 8, b)), moves to the left (FIG. 8, c)), and to the right (FIG. 8, d)).

FIG. 8 shows the position of the free floating element inside the piston for various situations.

Attaching the dampening elements between the helmet and the shoulders prevents the head from moving quickly upon impact. The dampeners allow free movement of the head when they move slowly and it takes place by allowing the piston to displace fluid or paste from the direction towards which it moves into the back section behind the piston. Upon rapid movement or impact, the fluid becomes highly viscous rigidizing the dampeners and preventing movement of the head relative to the torso/shoulder. Ball joints on the two ends of the individual dampeners allow flexible rotation of the individual dampeners on the mounting structure (FIG. 8). The piston inside the dampener's cylinder can be moved to adjust the dampener's length depending on the player's dimensions. A hollow shaft is extended out of the cylinder eliminating the need to deal with volume change inside the cylinder but it requires a longer dampening element or smaller workspace. If space is a big constraint then bellows can be used to accommodate the volume change. The hollow tube-shaped shaft on the back of the cylinder has holes to allow the piston rod to move in and out without compressing the air in this section of the dampeners.

Figure 9:
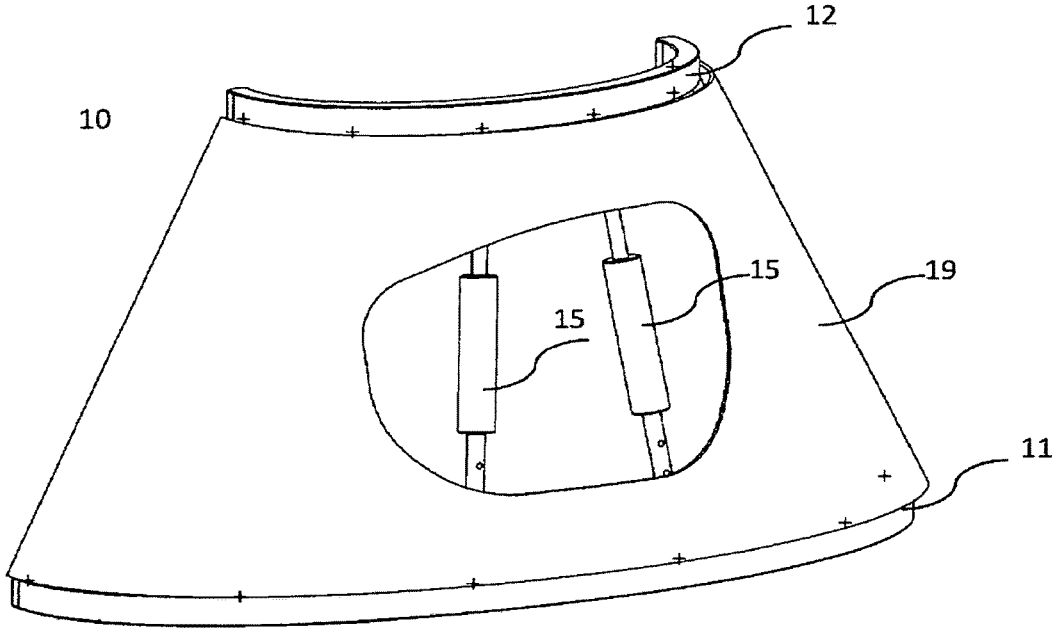
FIG. 9 is a view of the apparatus where a shroud covers the connecting elements.

FIG. 9 is a view of the apparatus where a shroud, 19, covers the connecting elements, 15, to prevent other players from using the elements for grabbing. The shroud is shown in this figure with a cutout in the middle section to reveal the connecting elements, 15.

Figure 10:
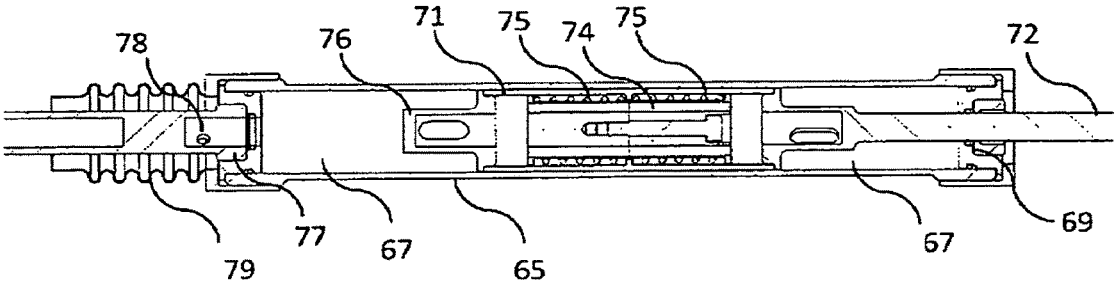
FIG. 10 is a view of the dampener connecting element where the double ended shaft was replaced with a single ended shaft and a bellows is used to accommodate changes in the dampener inner volume during the piston movement.

FIG. 10 is a view of the dampener connecting element where the double ended shaft was replaced with a single ended shaft where one end, 76, of the piston is shorter that the other end, 72. A bellows, 79, extends the seal cavity 67. A shaft, 77, presents a set of orifices, 78, that allow the scaled cavity 67 to communicate with the bellows 79 interior. The bellows accommodate the change in the fluid volume in cavity 67 as the piston's long shaft end 72 moves in and out of the housing 65.

A set of dampeners are mounted in a parallel platform configuration. In the illustration shown in this patent 6 elements are used (FIG. 1, FIG. 2 and FIG. 3) with their top structure connected to the helmet while their base structure mounted and connected to the user's shoulder pads and chest protector (FIG. 1). The use of the HISCoR structural frame takes advantage of the fact that the parallel platform can move in all the 6 DoF when pushed slowly and locks all of them to form a highly rigid structure when the dampeners are pushed rapidly under helmet impact. Thus, the head and torso have 6 DoF that are involved with their independent movement relative to each other. The dampeners' extension flexibility allows for self-adjustment for different players dimensions.

The attachment of both moving and base structures of the HISCoR platform can be done to preselected locations on the helmet and shoulder and chest protector allowing for rapid attachment and removal. Alignment and restraining features can be designed on the helmet, shoulders, chest protector, and the HISCoR to use attachment such as a bolt or a flexible element.

In another embodiment, shown in FIG. 8 the HISCoR platform is configured with the individual dampeners mounted such that two adjacent dampeners are connected either close or far from each other forming a hexagonal structure. The specific configuration implementation is selected based on the design optimization requirements.

The HISCoR apparatus is covered with a shroud, shown in FIG. 9, to prevent possibility of other players using the dampeners as a grabbing handle. The shroud can be made visually pleasing by producing it in colors and decorating it with printed graphics for possible use in advertisements or logos. The shroud is not critical to the functionality of the dampeners. Similar to the current rules that prohibit grabbing by the facemask, rules can be added to prohibit grabbing by the dampeners. The use of the shroud prevents the use of the dampeners as grabbing handles.

APPLICATIONS

Helmet Impact Self-Controlled Restrainer (HISCoR) is designed to prevent rapid rotation and displacement along the various potential axes onto which the head may be caused to move rapidly. To prevent the possibility of another player grabbing the dampeners of the HISCoR apparatus and use it as a handle, a shroud covers the fixture.

INCORPORATION BY REFERENCE

Any patent, patent application, patent application publication, journal article, book, published paper, or other publicly available material identified in the specification is hereby incorporated by reference herein in its entirety. Any material, or portion thereof, that is said to be incorporated by reference herein, but which conflicts with existing definitions, statements, or other disclosure material explicitly set forth herein is only incorporated to the extent that no conflict arises between that incorporated material and the present disclosure material. In the event of a conflict, the conflict is to be resolved in favor of the present disclosure as the preferred disclosure.

While the present invention has been particularly shown and described with reference to the preferred mode as illustrated in the drawing, it will be understood by one skilled in the art that various changes in detail may be affected therein without departing from the spirit and scope of the invention as defined by the claims.

What is claimed is:

1. An apparatus for dampening rapid movement of the human head relative to the body, a mechanical structure that restrains rapid movement, said apparatus comprising:

a base structure, a top structure and a plurality of connecting elements, wherein the connecting elements controllably locking the motion of the top structure with respect to the base structure;

wherein each of the connecting elements is independent and self-contained and consisting of a piston, a shaft, a housing, a fluid and a mechanism; said mechanism for preventing a free flow of the fluid inside the housing thus locking the motion of the piston inside the housing;

wherein the base structure is configured to be connected to the upper human body and the top structure is configured to be connected to a helmet structure that covers the human head;

wherein the connecting elements comprise a locking piston dampener mechanism; wherein said mechanism includes a free floating element with axial orifices and two springs; wherein said fluid moves from one side of the piston to the other through the axial orifices;

wherein when a piston movement speed higher than a design value, said fluid drag on the free floating element overcomes the forces in the springs and moves the floating element against one side of the piston blocking said axial orifices and preventing the fluid flow and locking the piston inside the housing.

2. The apparatus of claim 1, wherein the fluid consists of a viscoelastic material.

3. The apparatus of claim 2, wherein the viscoelastic fluid moves freely upon slow piston motion and is rigidized upon rapid movement.

4. The apparatus of claim 1, wherein the piston includes axial holes, said axial holes provide paths for the fluid to move back or forth depending on the direction of the piston movement inside the housing.

5. The apparatus of claim 1, wherein releasing the external force that acts on the locking piston or changing its motion direction unlocks the piston movement.

6. The apparatus of claim 1, wherein the connecting elements have ball joints on the two ends to provide flexible rotation of the connecting elements on the apparatus base and top structures.

7. The apparatus of claim 1, wherein the connecting elements have universal joints on the two ends to provide flexible rotation of the connecting element on the apparatus base and top structures.

8. The apparatus of claim 1, wherein bellows are used to accommodate changes in a total volume of the said fluid within the housing during the movement of the piston.

9. The apparatus of claim 1, wherein the shaft extends on both ends to prevent the change into the total volume of the said fluid within the housing during the piston movement.

10. The apparatus of claim 9, wherein a hollow tube-shaped shaft on the back of the encasing cylinder has holes to allow the piston shaft to move in and out without creating back pressure inside the housing shaft.

11. The apparatus of claim 1, wherein the connecting elements are covered with a shroud to reduce the possibility of other players to use the connecting elements as a grabbing handle.

12. The apparatus of claim 1, wherein the connecting elements are configured to allow length adjustment to match dimensions of different players.

* * * * *